United States Patent [19]

Klose et al.

[11] Patent Number: 4,532,727

[45] Date of Patent: Aug. 6, 1985

[54] FRAME, ESPECIALLY A QUICK-CHANGE FRAME FOR PHOTOGRAPHS

[75] Inventors: Odo Klose, Wupperal; Jochen Jost, Essen, both of Fed. Rep. of Germany

[73] Assignee: FILMOSTO-PROJEKTION Johannes Jost GmbH & Co., Essen, Fed. Rep. of Germany

[21] Appl. No.: 469,530

[22] Filed: Feb. 24, 1983

[30] Foreign Application Priority Data

Feb. 26, 1982 [DE] Fed. Rep. of Germany ..... 3206921
Apr. 6, 1982 [DE] Fed. Rep. of Germany ..... 3212758

[51] Int. Cl.[3] ..... A47G 1/06
[52] U.S. Cl. ..... 40/152
[58] Field of Search ..... 40/152, 152.1, 155; 46/31; 206/497

[56] References Cited

U.S. PATENT DOCUMENTS

| | | | |
|---|---|---|---|
| Re. 30,476 | 1/1981 | Jennen et al. | 40/152 |
| 2,367,071 | 1/1945 | Tarlitz | 40/152.1 |
| 2,680,698 | 6/1954 | Schnee | 46/31 |
| 3,339,302 | 9/1967 | Mallory | 40/152 |
| 3,523,382 | 8/1970 | Dreyer | 40/152 |
| 3,570,159 | 3/1971 | Burgener, Jr. et al. | 40/124.5 |
| 3,853,216 | 12/1974 | Jaeschke | 206/497 |
| 4,034,496 | 7/1977 | Cohen | 40/152 |
| 4,270,303 | 6/1981 | Xanthopoulos et al. | 46/31 |
| 4,319,419 | 3/1982 | Traill | 40/152.1 |
| 4,356,650 | 11/1982 | Antonczyk et al. | 40/160 |

FOREIGN PATENT DOCUMENTS

| | | | |
|---|---|---|---|
| 344368 | 7/1978 | Austria . | |
| 1693080 | 12/1954 | Fed. Rep. of Germany . | |
| 2442752 | 9/1974 | Fed. Rep. of Germany | 40/152 |
| 2853960 | 7/1980 | Fed. Rep. of Germany . | |
| 744591 | 4/1933 | France . | |
| 21788 | of 1913 | United Kingdom . | |

*Primary Examiner*—Robert P. Swiatek
*Assistant Examiner*—Cary E. Stone

[57] ABSTRACT

The frame is provided with several, at least partially straight sides and outwardly projecting locking elements formed on all sides, which are of such a complementary configuration that each side of a frame can be coupled with one side of another frame through the locking elements and several frames can be united in one plane to form a frame panel. The frame bodies can be injection molded from plastic in one piece with the locking elements. In another frame embodiment, each frame has a base plate and a frame overlay which can be fixed on the latter by fastening means, the outwardly projecting locking elements being formed on the outside margin of the base plate. The locking elements have preferably identical profiles and interspacing on all frames, so that frames of different frame sizes can be combined without problems.

19 Claims, 7 Drawing Figures

FRAME, ESPECIALLY A QUICK-CHANGE FRAME FOR PHOTOGRAPHS

BACKGROUND OF THE INVENTION

The invention relates to a frame, especially a quick-change frame for photographs, which can be joined modularly to other frames of the same kind to form a panel of frames or pictures.

For aesthetic reasons, people like to hang small-size picture frames, which are used, for example, as quick-change frames for photographs, together in groups, so as to arouse the impression, despite the small individual subjects, of a larger picture surface. Practically speaking, it is difficult and time-consuming to hang a great number of individual frames on a wall in such a manner that the frame sides are in line with one another or abutting one another. When the picture frames are hung singly, each frame needs its own hanger in the form at least of a nail on the wall. The wall is therefore relatively greatly damaged, depending on the number of pictures that are hung. The damage becomes undesirably apparent whenever the arrangement of the pictures is altered or reduced in size.

It has been the practice, therefore, to arrange and fasten several photographs side by side in a single large-size frame. The individual pictures are mounted either by suitable adhesives or by gripping them between a clear front glass and the back wall of the frame. Both the arranging and the mounting of a plurality of individual pictures in a single frame is difficult and time-consuming, and there is a risk that the pictures in the frame may shift out of place due to external vibration.

It is also known to join together a plurality of frames in rows and/or columns by means of separate, chain-like locking elements. The placement of the separate locking elements between adjacent frames and the precise alignment of the joined frames with one another also requires considerable effort in attaching the frame assemblage to a wall, and the separate locking elements themselves interfere with the opening and closing of the individual frames for the replacement of the pictures or subjects.

It is therefore the object of the invention to create modular frames which can easily and rapidly be joined together to form an assemblage on a wall and be altered in their relative arrangement, without additional aids or separate locking elements.

It is another aim of the invention to construct the frame sides such that the frames can be joined together to form a largely continuous, board-like unit, even when the side lengths are different.

SUMMARY OF THE INVENTION

For this purpose the invention provides, in the case of a frame with several at least partially straight sides, that locking elements which project outwardly beyond the outside edges of the frame are formed on the frame or on a platelike part of the frame and have an interlocking configuration such that each side of a frame can be coupled to [one of] at least two sides of another frame by means of the locking elements integral therewith and a plurality of frames can be combined in one plane to form a panel of frames. The interlocking means formed on the frame itself or on a part pertaining to the frame make possible the joining together even of frames of different sizes and styles. A plurality of picture frames can be coupled both one above the other and one beside the other in a few simple steps, and any desired number of single pictures can be assembled symmetrically or asymmetrically. The fastening of a single frame to a wall will suffice for the hanging of a great number of assembled picture frames. The interlocking of the frames in the described manner assures preservation of the mutual orientation of all frames and their support on the wall. On account of the reduced number of fastening points on the wall, visible damage to the wall when some of the frames are removed from the assemblage is avoided.

Preferably, a plurality of outwardly projecting holding shoes are distributed in a uniform pattern along at least a section of each frame side, two adjacent holding shoes defining on a frame a complementary intermediate space suitable for the accommodation of a holding shoe of the same shape. Each holding shoe can have a dovetail or T-shaped cross-sectional configuration.

Since the holding shoes on all sides of the frame are disposed in a uniform and identical pattern, several frames, even with sides of different length, can be coupled together and/or arranged with an offset from one another.

In the case of rectangular picture frames, the holding shoes on the two opposite frame sides should be offset from one another by half a pattern step, so that the two frames coupled to one another on two sides of equal length can be aligned with one another in a horizontal row or vertical column.

In the simplest embodiment, the frame itself can be injection-molded from plastic in one piece with the interlocking means. This one-piece embodiment of the frame and interlocking means, however, requires a separate manufacturing device, e.g., an injection molding die with close tolerances for each frame style and each frame size, and such a die is expensive and difficult to make.

According to a further aspect of the present invention, the possibilities for the variation of the layout of the picture panel with different frame styles and sizes can be substantially expanded if each frame has at least one base plate and an overlaid frame which can be locked on the base plate by fastening means and which defines the picture field on all sides, the outwardly projecting interlocking means being formed on the outer margin of the base plate. This division of a frame into the base plate bearing the interlocking means and the overlaid frame has the following advantages. The interlocking elements which are to be made within close tolerances are situated on a simple base plate. The overlaid frame of any particular style, however, can be made with correspondingly broad tolerances and shaped and varied according to aesthetic and practical considerations. Both relatively shallow picture frames as well as relatively deep frame-like elements or holders can be overlaid onto to the base plate and affixed thereto. These include:

(a) very deep frames behind whose covers sample goods are placed for display. Different display boxes can be combined by means of the corresponding base plates and can be interspersed with framed photographs or pictures.

(b) Containers for small parts or tools, which when coupled through the base plates can be assembled to form a filing or sorting system which can be expanded as desired and which can be interspersed with comparatively shallow picture frames.

The assemblage of frames can be fastened to a wall be means of one base plate. It can be changed about or expanded quickly and easily. The frame overlays can be changed about or replaced while the base plate array remains the same.

The base plates associated with different overlays can have a uniform size and type of interlocking means. It is important that the frame overlays themselves be able to be affixed by the fastening means to one or simultaneously to several base plates even in an arrangement encompassing a plurality of base plates. For this purpose the fastening means are disposed on the base plates, on the one hand, and on the frame overlays on the other, in a uniform pattern.

BRIEF DESCRIPTION OF THE DRAWINGS

Further advantages of the invention will appear from the following description of embodiments represented in the drawing, wherein.

DETAILED DESCRIPTION OF PREFERRED EMBODIMENTS

Figure 1:
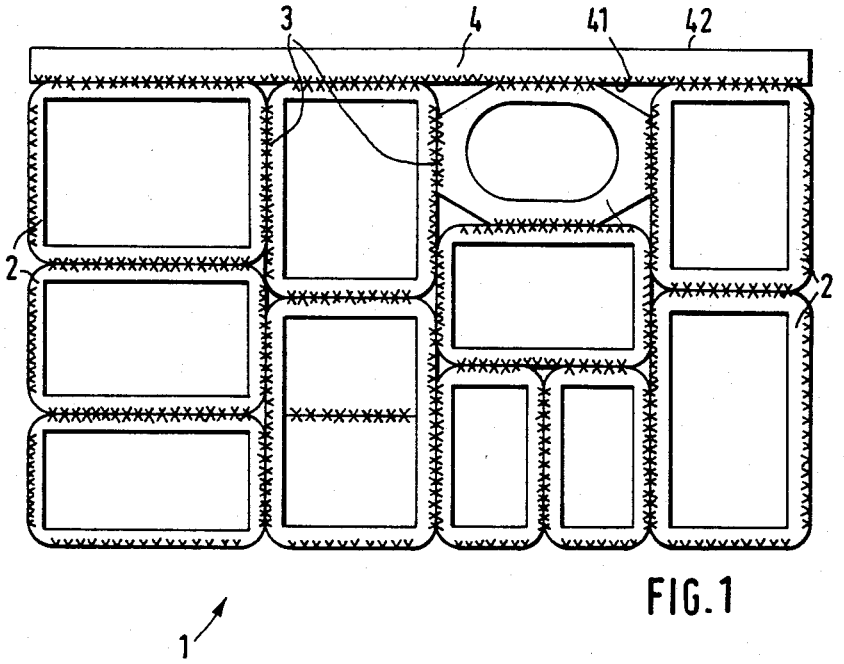
FIG. 1 is a diagrammatic plan view of a picture frame system in which a plurality of frames in accordance with the invention, some having different side lengths, are joined together in a unit by interlocking means fixedly situated thereon.

The frame panel or picture panel 1 diagrammatically represented in FIG. 1 consists of a plurality of frames, each being provided with interlocking means along its straight outer margins. The interlocking elements 3 indicated diagrammatically in FIG. 1 by crosshatching hold adjacent frames positively together in a single plane. The shape, size and relative arrangement of the frames and the composition of the frame panel are largely arbitrary, as the description that follows will indicate. What is important is the standardized design and the uniform and standardized pattern (division and spacing) of the interlocking elements along the outer margins of all frames. This makes it possible to lock up a plurality of frames, even of different side lengths, to form a frame panel or picture panel 1.

Figure 2:
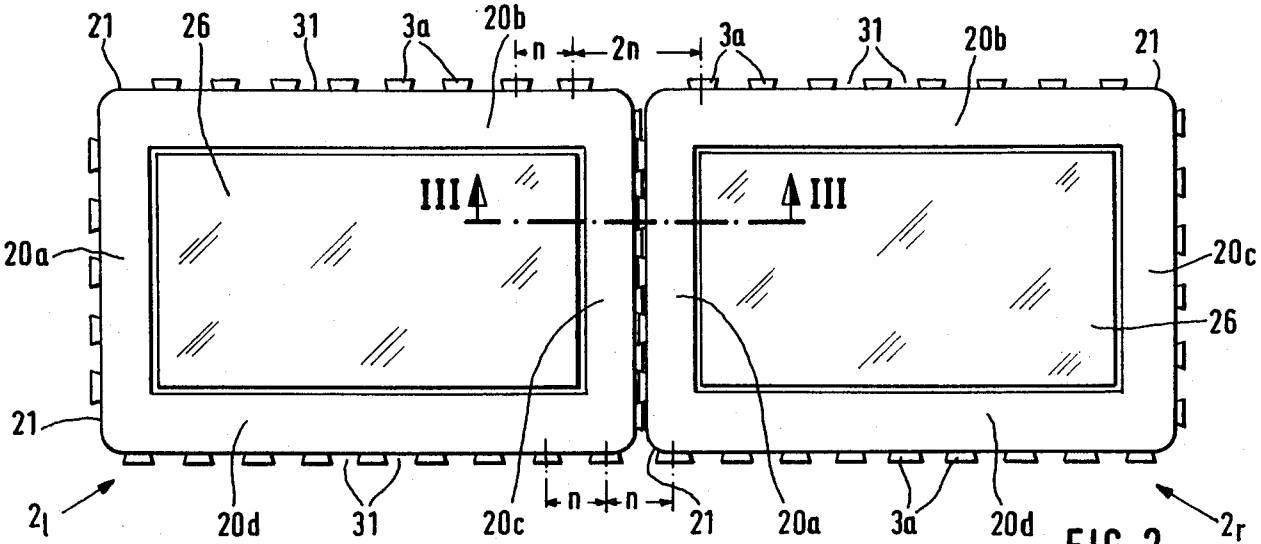
FIG. 2 is a diagrammatic plan view of two frames in accordance with the invention which are coupled together.
Figure 3:
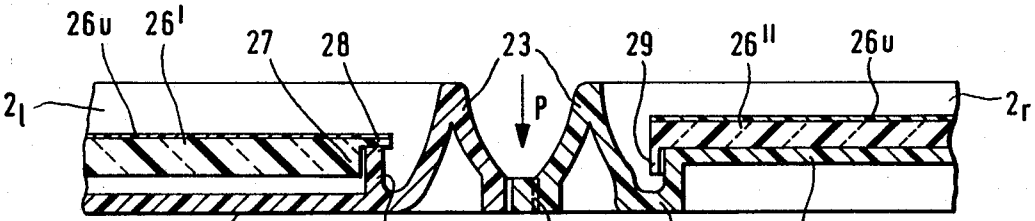
FIG. 3 is a fragmentary, cross-sectional view taken along line III—III of FIG. 2.

In the diagrammatic plan view shown in FIG. 2 of two interlocked frames $2_l$ and $2_r$, there is shown a first embodiment of interlocking elements *3a*, each in the form of holding shoes of the dovetail-like cross section. The holding shoes *3a* are formed on each of the four sides 20*a*, 20*b*, 20*c* and 20*d* of each of the two frames $2_l$ and $2_r$ in a uniform, standardized pattern (spacing n). The holding shoes *3a* project outwardly from the outside margin 21 of each frame and between themselves they define spaces 31 into which the holding shoes *3a* of the attached side (e.g. 20*a*) of the adjacent frame ($2_r$) are fitted. In this embodiment, the holding shoes *3a* on the sides diametrically opposite, 20*a* and 20*c*, and 20*b* and 20*d*, are offset from one another by half a pattern space. Thus the assembled frames $2_l$ and $2_r$, which are of the same size, can be coupled together to form a rectangular block of frames or pictures with aligned sides 20*b* and 20*d*. As it can be seen in the enlarged cutaway view in FIG. 3, the back surfaces of the holding shoes *3a* terminate in the plane of the back wall 22. For the addition of another frame 2 to a frame panel or picture panel, the holding shoes *3a* are aligned with the interstices 31 of the adjacent frame. Then the frame that is to be added is pressed against the wall as indicated by the arrow P in FIG. 3 (perpendicularly to the plane of the frame). The removal of a frame 2 is performed by lifting off the frame, i.e., by movement against the direction of arrow P. In the embodiment shown in FIG. 3, circumferential finger-grip strips 23 are formed adjacent the frame sides 20*a*, 20*b*, 20*c* and 20*d*, at which the frame can be grasped, particularly when it is being removed from a picture panel. Each frame of the embodiment shown in FIGS. 2 and 3 is preferably in the form of an integral plastic injection molding. In the injection molding process, the dovetail-like holding shoes *3a* can be formed simply and accurately, so that they hold positively and tightly together in the frame assemblage represented in FIG. 2.

In the case of frame $2_l$ in FIG. 3, a rectangular picture compartment is formed, which is defined by a circumferential bead 24. The picture, a photograph for example, is placed in the compartment and held flat and protected on the face side by a transparent cover 26, made preferably of plastic. To permit changing the picture without removing the frame from the wall or from the picture panel assembly, the cover 26 can be removed or tilted out of the frame from the front to such an extent that free access can be had to the picture compartment.

In FIG. 3, two transparent covers 26' and 26'' of different cross section are represented diagrammatically. In both cases the cover 26 is friction-fitted to the frame body and adapted to the latter such that it seals off the picture compartment formed between the back of the frame and the cover in a substantially air-tight and moisture-proof manner. The back wall of the frame (e.g., 25) is preferably continuous so that it protects the picture material contained in the picture compartment under the cover 26 reliably against the penetration of moisture.

The transparent cover 26' associated in FIG. 3 with the left frame $2_l$ has a rim 27 which is fitted into the picture compartment defined by the bead 24. The outer cross section of the rim 27 is adapted to the inside surface of the circumferential rib 24 such that friction provides a sufficient holding of the cover in the frame, and the picture compartment formed underneath the glass 26' is largely sealed up. On the front side the cover 26' has a circumferential flange 28 which rests against the circumferential bead 24 and preferably projects slightly beyond its outside edge so as to facilitate the removal of the cover.

In the frame $2_r$ shown on the right in FIG. 3, the sealed back wall 25 is provided with a table-like superelevation 25' which holds the picture in a plane parallel to the back surface 22. A transparent cover 26'' has a circumferential rim 29 which overlaps the circumference of the table-like superelevation and provides for a substantial sealing of the picture material against air and moisture.

The transparent cover 26, 26' or 26'' is provided with a coating **26*u*** acting as an ultraviolet filter. This reduces the danger of alterations of the colors of the picture material protected by the cover, the glass, especially by the ultraviolet content of light.

Figure 4:
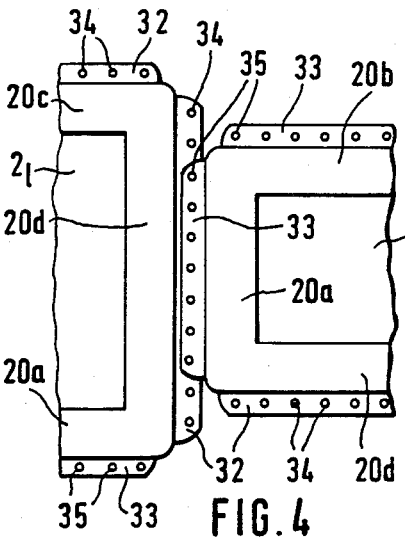
FIG. 4 is a diagrammatic, fragmentary view of two frames coupled together by snap-fastener-like interlocking means in an alternative embodiment of the invention.

In the fragmentary representation in FIG. 4, two frames $2_l$ and $2_r$ are provided with interlocking means consisting of complementary stud strips 32 and hole strips 33. The studs 34, which can also be short loops or pins, are distributed in a uniform pattern along the corresponding strip 32. The holes in the hole strips 33 are disposed in the same pattern as the studs 34. The backs of the stud strips 32 are preferably aligned with the back 22 (FIG. 3) of the frame 2, while the hole strips 33 are formed on the corresponding side of the frame but offset toward the viewer by the thickness of the strip 32. The attachment and detachment of the stud systems represented in FIG. 4 are performed perpendicularly to the panel. As an alternative, the direction of attachment of button strips can also be in the plane of the panel, in which case the corresponding holes and studs are formed in the plane of the drawing or of the panel. The preferred direction of closing and opening at right angles to the picture plane can be achieved in a stud system of alternative design by loops or pins which, like the holding shoes **3*a***, project outwardly from the outside of the frame and engage complementary snap-attachment grooves on the outside of an adjacent frame.

Figure 5:
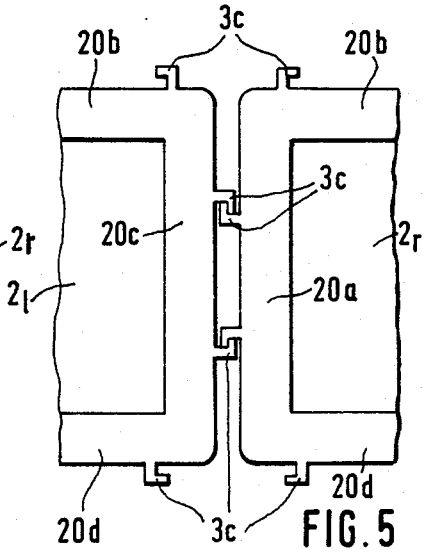
FIG. 5 is a diagrammatic, fragmentary view of the junction area between two frames each having hook-like interlocking means in accordance with a different embodiment of the invention.

In the case of the embodiment diagrammatically represented in FIG. 5, the interlocking elements are in the form of hook-like projections **3*c* which, on the side to be attached, engage oppositely pointing hook-like projections. In the drawing, the hooks 3*c* formed on the side 20*c* of the left frame $2_l$ form with one another a female connection, while the hooks 3*c* formed externally on the side 20*a* of the righthand frame $2_r$ together make up a male connector fitting the female connector. It can be seen in FIG. 5 that also the hooks 3*c* pertaining to adjacent frames $2_l$ and $2_r$ form on the frame sides 20*b* and 20*d*** corresponding male or female connectors into which the complementary hooks of another frame can be pushed.

Figure 6:
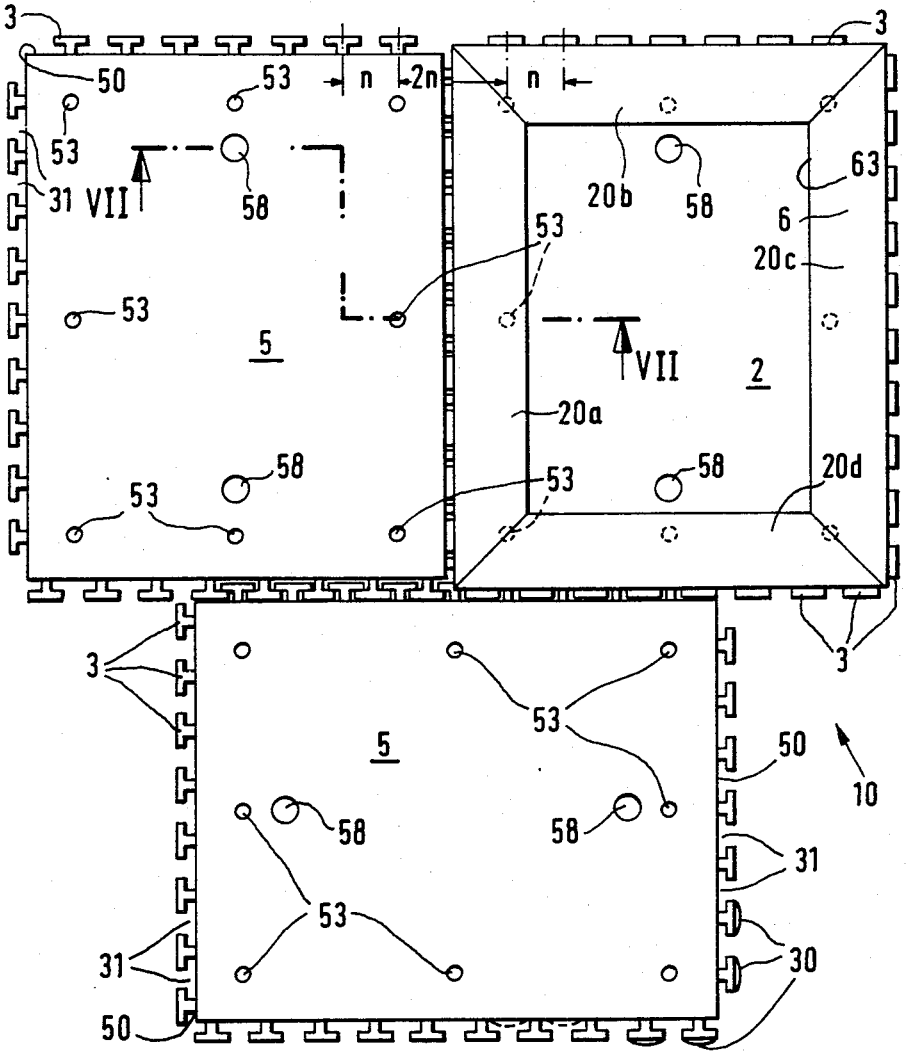
FIG. 6 is a plan view of an embodiment of a frame system in accordance with the invention, which consists in each case of frames each having at least one base plate and one overlaid frame, the interlocking means being formed on the base plates, and the frames being able to be snapped onto the base plates at suitable points.
Figure 7:
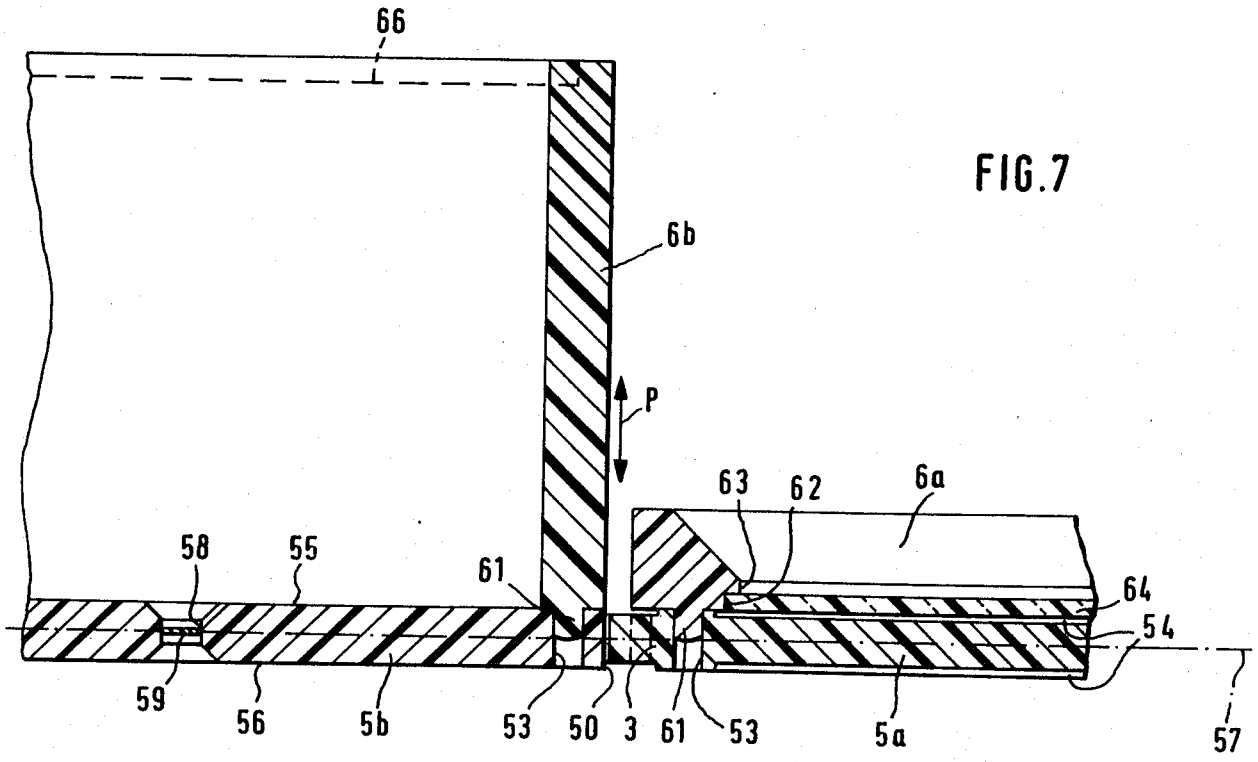
FIG. 7 is a fragmentary diagrammatic cross section on an enlarged scale along section line VII—VII of FIG. 6.

In the plan view of FIG. 6 and the cross-sectional view of FIG. 7, a plurality of frames of a multipartite embodiment are joined in one plane into a frame panel designated as a whole by 10. Each frame 2 consists of at least one base plate 5 and a frame overlay 6 which is held releasably on the base plate 5 by means of fastening elements. A plurality of base plates 5 locked up in a rectangular pattern can also be combined with a correspondingly large-size frame overlay 6 to form a frame 2. The base plates 5 can be fastened to a vertical wall, such as a room wall, for example.

Interlocking elements 3 are formed along the outer margin 50 of each base plate. These, in the examples represented in FIGS. 6 and 7, are holding shoes of T-shaped cross section which project outwardly in a uniform pattern of uniform spacing n from the margin 50 of the base plate 5. Pairs of the T-shaped holding shoes define intermediate spaces 31 into which T-shaped holding shoes of the adjacent side of an attached base plate interlockingly engage. The T-shaped holding shoes on one side of a base plate 5 are offset from those of the diametrically opposite side by half a space, i.e., by n/2. Thus a plurality of frames with sides of equal length can be coupled together to form a quadrilateral frame unit.

The uniform pattern of the interlocking elements 3 of the spacing n is continued through the seam between two coupled frames or base plates 5. As shown in FIG. 6, the outermost interlocking elements 3 in each case are disposed at such a distance from the adjacent frame corner that their average distance from the next interlocking element of the adjacent frame is equal to one space n or an integral multiple of n. In FIG. 6, two rows of interlocking elements 3 are aligned with the two vertically disposed coupled frames or base plates 5. In the upper row (frame side **20*b*) the adjacent interlocking elements of different frames have a distance on centers of 2n, while the corresponding distance on centers in the bottom row (frame side 20*d*) is equal to one space n. (This difference is due to the above-mentioned offsetting of the interlocking elements by a half of a space n/2 on diametrically opposite sides of a frame or base plate.) The frames or base plates with the same pattern can therefore be joined both to the bottom row (horizontal base plate 5 in FIG. 6) and to the upper row of interlocking elements so as to overlap at selectable points, and either one interlocking element 3 (below) or two interlocking elements (upper row) are inserted between two adjacent elements 3 of coupled frames. A similar continuation of the pattern spacing across the coupling seam between two adjacent frames is also provided in the case of the embodiments previously described in conjunction with FIGS. 2 to 5**.

To render harmless any shrinkage that might occur after the injection molding of the base plates 5, the T-shaped holding shoes 3 should engage the recesses 31 with lateral clearance; that is, the T-shaped holding shoes should have shorter crossbars and a narrower stem than the width of the corresponding interstices between two adjacent holding shoes. This is indicated in FIG. 6 by small gaps between the engaged interlocking elements of adjacent base plates 5.

The interlocking elements 3 can be provided, in accordance with the diagrammatic representation, with lens-shaped heads 30 at the lower right corner of the bottom base plate 5 of FIG. 6, these heads pressing against the edge 50 of the attached base plate and producing a certain gripping action in the seam between two adjacent base plates 5. Alternatively, the outer margin 50 can be provided in the center of each intermediate space 31 with convexly curved projections which have the same action as the lens-like heads 30 of the interlocking elements 3.

Instead of the T-shaped interlocking elements 3 represented in FIG. 6, the dovetail-like, hooked or stud-type interlocking elements **3*a*, 3*c* or 34, 35 represented in FIGS. 2 to 5 can be formed on the edges 50 of the base plates 5**.

The frame overlays 6, of which only one is shown in FIG. 6, can be locked from the front side onto the corresponding base plate 5 by suitable fastening means, preferably snap fastenings. In the embodiment represented in FIG. 7, each frame overlay **6*a* and 6*b* is provided with plugs 61 which can be inserted into mating bores 53, preferably in a frictionfitted manner. The bores 53 are at least partially disposed in a given pattern of uniform spacing. Mating fastening means, in this case plugs 61, are disposed in the same spacing on the adjoining surface of the frame overlay 6 or 6***a* and 6*b*.

The division of the frame into a base plate 5 and surmounting frame 6 with the interlocking elements 3 disposed on the outside margins of the base plates facilitates the manufacture of frames of different styles and sizes. As it can be seen in FIG. 7, identical base plates 5*a* or 5*b* with frame overlays of entirely different styles and shapes can be combined.

The frame overlay 6*a*, which in FIG. 7 is fastened on the base plate 5*a*, is in the form of a frame for holding a picture. On the inside of the frame overlay 6*a* there is formed a recess 62 for the accommodation of a transparent cover 64 to protect the front of the picture area 63. The cover 64 can be cemented into the recess 62. A recess 54 is also formed in the base plate 6*a* and together with the transparent cover 64 defines a compartment for a photograph. The cover 64 can project slightly into the recess 54 for the purpose of pressing the picture or photograph against the base plate. The cover 64 can be provided with a coating (26*u*—FIG. 3) acting as an ultraviolet filter.

The attached base plate 5*b*, in the example shown in FIG. 7, is in the form of a flat plate. The T-shaped interlocking elements are, like the corresponding base plates 5*a* and 5*b*, in a substantially symmetrical relationship on both sides of a plane of symmetry 57. Thus, each of the two flat sides 55 or 56 of each base plate 5 can serve either as a surface for the attachment of the corresponding frame overlay 6*a* or 6*b*, or as a back side. This increases the possibilities for combining a plurality of frames in a frame panel.

In the pattern of the frame arrangement 10 in FIG. 6, two open corners are shown, one on the left and one on the right of the one horizontally oriented base plate 5 under the two vertically disposed base plates. It is easy to see that, if the pattern of the interlocking elements is the same, additional base plates can be fitted into the corners in the horizontal position but not in the vertical position. A fitting of vertically oriented base plates into the corners shown can be accomplished, however, without interference if the base plate is reversed to the other flat side and the corner of the base plate 5 illustrated with lens-shaped heads 30 is fitted into the right-hand open corner. In the case of a one-piece frame, the flat sides cannot be arbitrarily turned about, so that the frames cannot always be brought into the interlocking position.

The frame overlay 6*b*, in the embodiment represented in FIG. 7, is a frame-like mounting that is relatively deep in comparison with the picture frame overlay 6*a*, and together with the base plate 5*b* it can form, for example, a cubby or a container for small parts. By providing a transparent cover 66 or transparent door on the front side of the frame overlay 6*b*, a display case is created. The style, size and shape of the frame overlays 6*a* and 6*b* in the frame panel system of FIGS. 6 and 7 are virtually freely selectable independently of the form of the interlocking elements. The frame overlays in the base-plate system can be removed and interchanged as desired. It is important that the base plates 5 have openings wherever snap-fastening plugs 61 exist on the frame overlays; on the other hand, not all of the bores or other sockets for plugs 61 or other projections of the frame overlays need to be used. In the case of smaller and less stressed frame overlays, the engagement of two studs 61 into mating bores 53 will often suffice.

In order to conceal the rows of interlocking elements 3 in a frame panel as seen from the front, the frame overlay 6*a* can project laterally beyond the outer edge 50 of the base plate 5 to about the center of the overlap of the interlocking elements. Adjacent frame overlays 6 on assembled base plates 5 then reach about to the center of the seam and virtually completely conceal the row of interlocking elements. In this case the result will be a frame arrangement which is also sealed up at the junctions and whose interlocking elements are not visible from the front.

To hold an individual frame or the entire frame system 10 in place, special bores 58 are provided in each base plate 5 of the embodiment represented in FIGS. 6 and 7. They can be in the form of chamfered bores (FIG. 7) so that the corresponding base plate 5*b* can be fastened to a wall with flat-head screws. In the described system it is sufficient to fasten just one base plate 5*b* to the wall with flat-headed screws, while all other frames of the frame system 10 are held on the wall by the interlocking elements and the mounted base plate 5*b*. Therefore, the pattern of the frame system 10, if only one base plate 5 is fastened to a wall, can be rearranged afterward, and additional base plates 5 can be installed or base plates 5 can be removed. The installation and removal of a new bas plate is performed in the direction of insertion indicated by the double arrow P in FIG. 7.

The preformed mounting holes 58 can be closed by a thin skin (membrane) 59 to protect the chamber containing the picture or the display case 6*b* behind a transparent cover 64 against the penetration of moisture from the wall. If a base plate is to be fastened to a wall, the corresponding membrane 59 can be pierced with a nail or screw. In the case of other base plates which are joined to the wall indirectly through their interlocking elements and the mounted base plate, the membrane 59 is left intact and protects the frame against moisture penetration.

The frame system of FIGS. 6 and 7 does not really need special mounting holes 58. It can be fastened to a wall also by means of studs engaging the preformed and throughbores 53 or bores open at both ends.

An alternative method of fastening the frame system to a wall is represented in FIG. 1. A mounting strip 4 is shown on the top of the frame panel 1, and on its longitudinal margins 41 and 42 interlocking elements are formed which are of a shape complementary to those of frames 2. The flush sides of several frames 2 can be coupled to this strip in the same manner as the outsides of the frames are coupled to one another. The frames 2 can be mounted both above and below the mounting strip 4. The base plates 5 of FIGS. 6 and 7 can also be fastened to the mounting strip.

The form, arrangement and design of the interlocking elements can be varied in many ways and adapted to particular requirements of manufacture and use. It is important that adjacent frames be locked together by means of the interlocking elements formed on the outer edge of each frame, preferably on all sides, so that a plurality of individual frames 2 can be locked up in a single plane to form a frame panel 1. It is sufficient to fasten only one or a few of the frames combined into a frame panel to a wall. The frames can also be joined in an asymmetrical arrangement, with partial gaps and interstices, by means of complementary interlocking elements 3, as shown in FIG. 1. The important thing is that the interlocking elements of all of the frames to be assembled in a frame system 1 or 10 have a uniform design, spacing and pattern, so that the frames can be joined together continuously and overlappingly in a single plane.

It is to be understood that the invention is not limited to the embodiments described and shown but encompasses all modifications within the scope of the appended claims.

We claim:

1. A frame for receiving loose objects and for mounting same on a vertical wall, said frame having a circumferential outer margin in a frame plane and having at least partially straight margin sections, and having:

a substantially planar back wall having a front side;

a frame rim protruding from said back wall towards the front and laterally surrounding a frame inner field on the front side of said back wall; and locking elements formed on at least part of the straight margin sections of the outer margin, said locking elements projecting outwardly from the outer margin in a uniform pattern substantially in the frame plane, adjacent locking elements formed on each straight margin section defining pair-wise an intermediate space for accommodating locking elements of like form, the pattern spacing n of said locking elements being such that the locking elements of one frame may engage the intermediate spaces between locking elements of a coupled adjacent frame forming a coupling seam between parallel straight margin sections of said coupled frames, the shape and arrangement of said locking elements being such that locked locking elements of two engaged frames can be disengaged only by movement of said frames in a direction perpendicular to said frame plane while said locking elements of said two engaged frames are non-disengageably interlocked in said frame plane in all directions, several locking elements being arranged in a pattern with uniform pattern spacing n in a row along each frame side, the locking element pattern spacing on aligned sides of coupled frames being continued beyond their coupling seam with the same pattern spacing n or an integral multiple of the spacing n, whereby a further frame may be coupled to the aligned sides of coupled frames in a position overlapping said coupling seam therebetween.

2. A picture frame having frame sides extending in pairs approximately perpendicular to each other and defining straight margin sections, said sections being confined by a circumferential substantially rectangular outer margin, said frame comprising:

a frame body as a one-piece plastic injection molding, said frame body having:

a substantially planar back wall having a front side, a frame rim protruding from the back wall to form frame sides and to laterally surround a frame inner field on the front side of said back wall, and locking elements formed on at least part of the straight margin sections of the outer margin, said locking elements projecting outwardly from the outer margin in a uniform pattern substantially in the frame plane, adjacent locking elements formed on each straight margin section defining pair-wise an intermediate space for accommodating locking elements of like form, the pattern spacing n of said locking elements being such that the locking elements of one frame may engage the intermediate spaces between locking elements of a coupled adjacent frame forming a coupling seam between parallel straight margin sections of said coupled frames, the shape and arrangement of said locking elements being such that locked locking elements of two engaged frames can be disengaged only by movement of said frames in a direction perpendicular to said frame plane while said locking elements of said two engaged frames are non-disengageably interlocked in said frame plane in all directions, several locking elements being arranged in a pattern with uniform pattern spacing n in a row along each frame side, the locking element pattern spacing on aligned sides of coupled frames being continued beyond their coupling seam with the same pattern spacing n or an integral multiple of the spacing n, whereby a further frame may be coupled to the aligned sides of coupled frames in a position overlapping said coupling seam therebetween, and a transparent cover arranged substantially parallel to said planar back wall and defining at the front a picture compartment in the area of the frame inner field.

3. In a frame and display case system for fixedly connecting loose objects to a vertical wall, a frame module comprising:

at least one essentially rectangular, flat base plate for forming part of a system back wall and adapted to be fixed to the vertical wall, said base plate having a circumferential outer margin substantially in a plate plane and having straight margin sections extending substantially perpendicular to each other, locking elements formed on at least part of the margin sections of the outer margin, said locking elements projecting outwardly from the outer margin in a uniform pattern substantially in the frame plane, adjacent locking elements formed on each straight margin section defining pair-wise an intermediate space for accomodating locking elements of like form, the pattern spacing n of said locking elements being such that the locking elements of one frame may engage the intermediate spaces between locking elements of a coupled adjacent frame forming a coupling seam between parallel straight margin sections of said coupled frames, the shape and arrangement of said locking elements being such that locked locking elements of two engaged frames can be disengaged only by movement of said frames in a direction perpendicular to said frame plane while said locking elements of said two engaged frames are non-disengageably interlocked in said frame plane in all directions;

a frame overlay for the confinement on all sides of a rectangular frame inner space; and connecting means for the detachable fixing of the frame overlay on at least one base plate, whereby the frame inner space is delimited on the back side by at least one base plate and laterally by the essentially rectangular circumferential frame overlay.

4. A combination according to claim 1, 2 or 3, wherein the locking elements of two coupled frames form a coupling seam between parallel straight margin sections of said coupled frames and interlock with slight clearance in longitudinal direction of the coupling seam.

5. The combination according to claim 3, wherein several locking elements are arranged in a pattern with uniform pattern spacing n in a row along each frame side, and wherein the locking element pattern spacing on aligned sides of coupled frames is continued beyond their coupling seam with the same pattern spacing n or an integral multiple of the spacing n.

6. The combination according to claim 1, 2 or 5, wherein the locking elements on two confronting frame sides are offset by one-half of the pattern spacing n/2 such that two frames of equal form are adapted to be connected to an approximately rectangular frame combination.

7. The combination according to claim 6, wherein the locking elements have a dove tail cross-sectional profile.

8. The combination according to claim 6, wherein the locking elements have a T-shaped cross-sectional profile.

9. The combination according to any one of claims 1, 2 or 3, comprising a closed back wall of the frame, said back wall having a hole, and a thin skin closing said hole in an air-tight and moisture-proof manner so that said back wall forms a moisture barrier.

10. In combination: a plurality of frames according to claim 1, 2 or 3, arranged in a frame plane, and further comprising an elongated connecting strip having along its elongated straight margin a plurality of locking elements, said last mentioned locking elements being adapted to interlock with the locking elements of said frames.

11. A frame according to claim 2, comprising a circumferential bead laterally confining a space for said picture compartment, said bead extending from the back wall towards the front, said transparent cover having a plug part adapted to be fitted into the space confined by the bead, and also having a circumferential marginal flange overlapping the circumferential bead of the frame.

12. A frame according to claim 2, wherein said back wall in the area of the inner field has a table-like elevation projecting towards the front, said transparent cover being hoodlike and having a circumferential flange for fitting onto the table-like elevation, whereby a picture may be held flat between the table-like elevation and the transparent cover.

13. A frame according to claim 2, wherein said transparent cover is provided with a coating acting as an ultraviolet filter for the protection of the material of the picture.

14. A frame module according to claim 3, in which each base plate has two opposite flat sides and with its associated locking elements and connecting means is surface-symmetrical to a central plane so that each of said two flat sides is adapted to form the front or back side of the base plate.

15. A frame module according to claim 3, wherein said connecting means for fixing the frame overlay to at least one base plate are plug fasteners composed of plugs and sockets, on said base plate being formed either only said sockets or said plugs and on said frame overlay only the complementary components of said plug fasteners, in mating arrangement.

16. A frame module according to claim 14 or 15, wherein said connecting means are distributed on each base plate such that their pattern continues with equal pattern steps across said coupling seam of two adjacent base plates from one to the adjacent base plate so that a frame overlay with its associated connecting means is adapted to be fastened to two adjacent base plates by spanning the coupling seam.

17. A frame module according to claim 3, wherein the frame overlays of two coupled frames project outwardly beyond the outside margins of the respective base plates so that they essentially conceal frontally the interlocking locking elements in the coupling seam.

18. The combination of claim 3, wherein said frame overlay comprises a rectangularly circumferential wall extending perpendicular to the back wall and together with said back wall forming a cubby.

19. The combination according to claim 3, wherein said frame overlay has a circumferential wall extending perpendicular to the back wall, a transparent cover plate covering the front of said circumferential wall; said frame overlay, said back wall and said cover plate together defining a display box.

* * * * *